US005168811A

United States Patent [19]

Cox et al.

[11] Patent Number: 5,168,811

[45] Date of Patent: Dec. 8, 1992

[54] METHOD AND APPARATUS FOR ACCELERATING SETTING AND DRYING OF LIQUID MEDIA

[75] Inventors: Clifford E. Cox, Brookston, Ind.; John A. Stout, Hinsdale, Ill.

[73] Assignee: CSB Corporation, Brookston, Ind.

[21] Appl. No.: 753,805

[22] Filed: Sep. 3, 1991

Related U.S. Application Data

[63] Continuation-in-part of Ser. No. 585,784, Sep. 20, 1990, abandoned.

[51] Int. Cl.[5] ..... B41F 35/00

[52] U.S. Cl. ..... 101/424.1; 101/416.1

[58] Field of Search ..... 101/416.1, 424.1, 487; 34/4, 40, 41

[56] References Cited

U.S. PATENT DOCUMENTS

| | | | |
|---|---|---|---|
| 4,123,851 | 11/1978 | Itoh et al. | 34/48 |
| 4,640,022 | 2/1987 | Suzuki et al. | 34/48 |
| 4,809,608 | 3/1989 | Wolnick et al. | 34/41 |
| 4,876,436 | 10/1989 | Ide et al. | 219/370 |

OTHER PUBLICATIONS

TDK PTC Thermistors (Catalog #BEE-004A) Feb. 1988, 32 pgs., Printed in Japan for TDK Corporation.

Scarlett, et al., "What the Printer Should Know About Ink", pp. 74–84 (1984).

*Primary Examiner*—Edgar S. Burr
*Assistant Examiner*—Ren Yan
*Attorney, Agent, or Firm*—Fitch, Even, Tabin & Flannery

[57] ABSTRACT

A method and apparatus in which one or more positive temperature coefficient thermistors heat air for application to printed stock in a printing press. The apparatus is preferably mounted on the press, located a short distance above stock traveling from a printing station to a delivery station. The apparatus directs air flow downward over or through the PTC thermistors and into contact with the printed stock. Preferably, variable-speed fans provide forced airflow for this purpose. The rate of heat output of the apparatus may be varied. The preferred PTC thermistors are supported on a frame of adjustable or variable length adapted to span the width of various transfer beds or printing presses to facilitate installation of the apparatus on presses of varying dimensions and configurations.

26 Claims, 3 Drawing Sheets

METHOD AND APPARATUS FOR ACCELERATING SETTING AND DRYING OF LIQUID MEDIA

This is a continuation-in-part of co-pending application Ser. No. 585,784, filed Sep. 20, 1990, now abandoned.

BACKGROUND OF THE INVENTION

1. Field of the Invention

The invention relates generally to printing, and more particularly to a method and apparatus for effecting temperature-controlled airflow to accelerate setting and drying of inks, varnishes, or coatings on stock in a printing operation.

2. Description of Related Art

In printing operations, the time required to run a particular job is in part dependent upon the time required for drying of liquid media such as inks, varnishes or water-based acrylic coatings applied to a substrate. The term "drying" is used broadly herein, and includes oxidative polymerization of inks and varnishes commonly employed in sheet-fed lithographic presses, in addition to evaporation of water from water-based inks and coatings.

In some printing operations, such drying begins shortly after ink is applied with formation of a skin on the ink, i.e., "setting" of the ink, and continues after the printed stock is placed in a pile at a delivery station. In such operations, the temperature and heat capacity of the stock affect the rate of drying, and the core temperature of the accumulation of stock at the delivery station, i.e., "pile temperature", is ideally maintained at an elevated temperature, e.g., about 100° F., until the process is substantially completed.

In a sheet-fed lithograph press, when a sheet is placed in a pile and later-printed sheets are continuously added to the pile, the weight of the later-printed sheets can cause undesirable transfer of ink, or "set-off", from the particular sheet to the next adjacent sheet, if the rate at which the ink dries on the particular sheet is not high enough relative to the rate at which subsequent sheets are added. Moreover, even after ink has sufficiently dried to avoid set-off in the pile, several hours of additional drying time may be required prior to subsequent finishing operations, additional printing, or delivery of the job, in order to avoid smearing or other deleterious disturbance of the printing.

In the case of water-based acrylic coatings, water is evaporated from the coating in a relatively short time period by infrared heating or blowing of hot air over the coating. It has been found that the rate of drying of such coatings is greatly affected by the rate of air flow. Pile temperature is generally not considered important, because the coating is substantially dried before the stock is stacked at the delivery station, and the coating prevents set-off whether or not the underlying ink is dry. Such coatings generally are applied only in high-pile presses. Low-pile presses generally are not capable of applying such coatings.

It is well known that employment of infrared heating units can reduce the need for spray powder and reduce turnaround time in the context of non-coated, printed stock, by increasing rates of drying inks. However, commercially available infrared dryers have several shortcomings. Infrared dryers are generally inefficient in drying water-based coatings, and typically employ radiators which may operate at temperatures above the combustion temperature of paper stock, thereby presenting potential fire hazards. Also, the high operating temperatures of infrared heating devices may result in undesirable and inefficient increases in ambient air temperature, and excessive heating of the press itself, accelerating wear. The heat generated during normal operation of infrared radiators may require water-cooling or exhaust systems to protect the press from excessive heat, and the energy consumption of such infrared radiators is generally undesirably high. Furthermore, the capital costs and operating expenses associated with such apparatus may render it economically unfeasible in certain contexts, particularly in low-pile presses.

There is a need for improved means to dry inks and coatings in printing presses, particularly in low-pile presses, in which dimensional constraints limit access to printed stock.

SUMMARY OF THE INVENTION

The invention comprises a method and apparatus for effecting temperature-controlled airflow over printed stock in a printing press to accelerate setting and drying of liquid media such as inks, varnishes, and coatings on the stock. One or more positive temperature coefficient (PTC) thermistors are employed to control air temperature. The apparatus is preferably mounted so as to be positioned a short distance above the stock as it travels from a printing or coating station to a delivery station. The apparatus preferably employs means to effect forced air flow downward and over or through the PTC thermistors and into contact with the printed stock.

The airflow may be effected by variable speed fans, such that the rate of heat output of the apparatus may be varied over a relatively wide range simply by varying fan speed, with relatively little variation in the operating temperatures of the PTC thermistors. Variation of the heat output of the apparatus may alternatively be enabled by providing means by which a plurality of PTC thermistors may be switched on and off independently of one another to permit variation of the number of thermistors in operation at any particular time, or by employing a chopper-type controller to provide discontinuous power to the thermistors. In accordance with a further alternative, heat output may be varied by providing a thermostatic controller to switch power simultaneously to all of the thermistors in response to comparison of output air temperature with a preset reference temperature.

It is believed that the invention will enable achievement of substantial improvements in efficiency, and concomitantly substantial decreases in energy consumption, in that the air flow effected by the apparatus will enable setting and/or drying of the ink to be achieved in an acceptably short period of time with heat generation and power consumption limited to relatively low levels.

The PTC thermistors are preferably arranged in one or more clusters, with each thermistor or "pill" pill comprising a flat, substantially triangular element having a plurality of perforations formed therein. Air is forced downwardly through the apertures in each PTC thermistor. The PTC thermistors and fans are preferably supported on a frame of adjustable or variable length adapted to span the width of various transfer beds to facilitate installation of the apparatus on presses of varying dimensions and configurations.

DETAILED DESCRIPTION OF PREFERRED EMBODIMENTS

Figure 1:
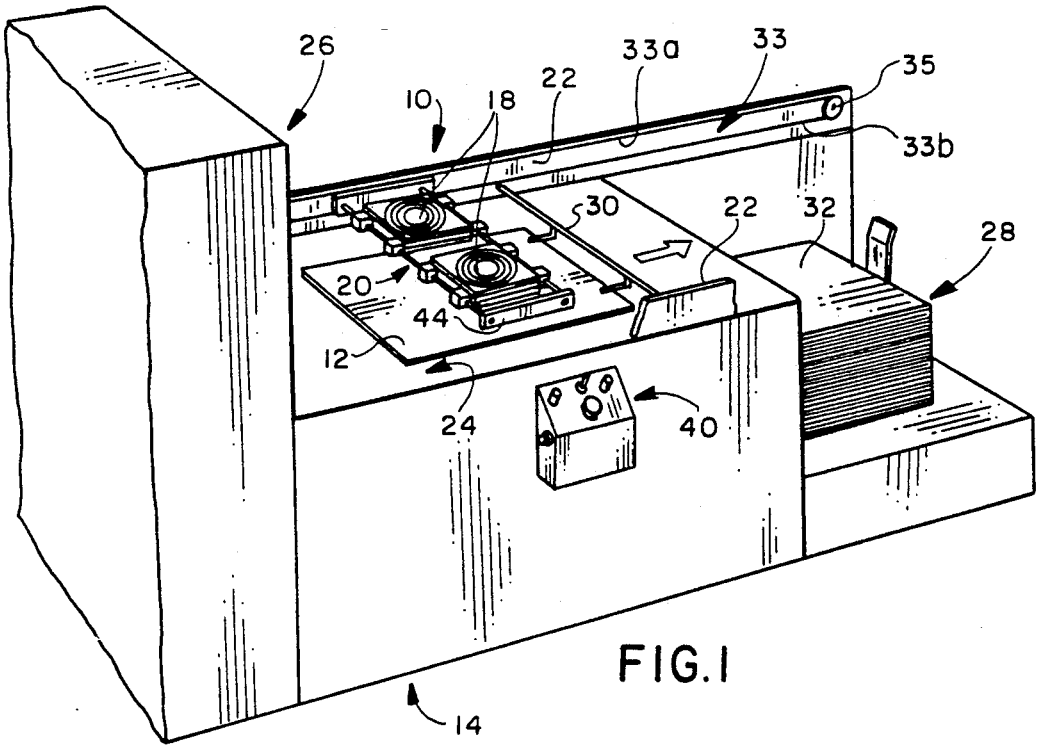
FIG. 1 is a perspective view of apparatus in accordance with the invention installed on a printing press, with portions of the printing press broken away for purposes of clarity.

The invention is preferably embodied in a method and apparatus 10 for accelerating setting and drying of liquid media such as inks, varnishes and coatings on printed stock 12 in a press 14 by effecting temperature-controlled airflow over the stock. The term "stock" is used generically herein to denote materials of the type which may be fed through printing presses, including paper stock in both sheet and web form, and other materials.

In accordance with the invention, the heating apparatus 10 employs one or more PTC thermistors 16 to generate heat for transfer to air which flows over the inks, varnishes or coating on the stock 12. The thermistors are preferably operated at a temperature below the combustion temperature of the stock. The illustrated apparatus includes two separate hexagonal assemblies or clusters 15 of six triangular thermistor units or "pills" 16. The hexagonal assemblies are arranged side-by-side, substantially coplanar with one another, disposed in a generally horizontal orientation. Each of the thermistors 16 is substantially triangular. Suitable fans 18 are provided adjacent the thermistors 16 to force air into heat exchange relationship with the thermistors so as to heat the air to a desired temperature, and to effect flow of the heat air over the printed stock 12. The flow of heated air over media such as inks, varnishes, and/or coatings on the stock accelerates setting and drying of such media. The thermistors 16 and fans 18 are preferably supported by a frame 20 adapted for mounting on vertical sidewall surfaces 22 of a printing press.

FIG. 1 illustrates apparatus in accordance with a preferred embodiment of the invention installed over a transfer bed 24 between a printing station 26 and a delivery station 28 (in a low-pile lithographic printing press 14). In the illustrated operation, a transfer gripper assembly 30 pulls each sheet from the printing station 26 to the delivery station 28 and places the sheet 12 on top of a pile 32. As the sheet travels over the transfer bed 24, it passes beneath the heating apparatus 10, which is preferably spaced above the transfer bed by a relatively short distance, e.g., about ½ in. to 4 in.

It should be appreciated that in other embodiments, e.g., in certain high-pile press configurations, thermistors might alternatively be mounted at a remote location, with a duct provided to carry heated air from the thermistors to the location at which the stock is to be heated. The thermistors in this context could operate at relatively high temperatures, e.g., about 260° C.

The illustrated arrangement provides an advantage insofar as it provides a compact source of heat which can be mounted directly adjacent the stock on the press between the upper and lower chain rails 33*a* and 33*b* respectively of the transfer gripper drive chain 33, which runs are typically spaced by only a few inches in low-pile presses. The small vertical dimension of the apparatus 10 is significant due to the fact that the transfer gripper assembly 30 in the press travels in a continuous looped path, proceeding to the right in FIG. 1 until it reaches the delivery station 28, then traveling up around sprocket 35 and traveling to the left in FIG. 1 in an elevated position to return to the printing station for engagement with another sheet. In a typical sheet-fed press employing this type of gripper, several gripper assemblies 30 are associated with the gripper drive chain 33. The heating apparatus must be configured to avoid interference with the travel of the gripper assemblies.

PTC thermistors are characterized by a sharp increase in electrical resistance as a function of temperature. For example, the resistance of the preferred PTC thermistors increases by a factor of over 1000 in response to a temperature increase of from 150° C. to 200° C. Known PTC thermistors are made of an oxide semiconductor ceramic comprising barium titanate doped with trivalent ions such as yttrium or pentavalent ions such as niobium.

A significant characteristic of the thermistor is its Curie temperature, which is a temperature at which a rapid increase in resistance as a function of temperature occurs, and at which the thermistor has a resistance of twice the minimum resistance value, with resistance being measured using a terminal voltage of 1.5 volts DC or less. The preferred PTC thermistors 16 are commercially available thermistors which have a Curie temperature in the range of 180° C. to 260° C., specifically about 190° C. Each has conductive coatings on its upper and lower surfaces, with respective leads 34 connected to the upper and lower surfaces so that application of a voltage across the respective leads effects current flow across the semiconductive element over the entire area thereof.

The thermistors 16 selected for the illustrated embodiment have transverse (vertical) openings formed therethrough for air flow. The illustrated thermistors have a plurality of small circular perforations 36 for this purpose. Each perforation has a diameter of about 1 mm and is typically equally spaced from six adjacent perforations disposed at 60° intervals at center-to-center distances of about 2 mm. Air flow over or through the thermistors might also be achieved by alternative configurations for the thermistors, e.g., by vane configurations, or other arrangements, in other embodiments of the invention. In the illustrated embodiment, each of the PTC thermistors 16 is sandwiched between two plastic support members 38, which define triangular frames for the thermistors.

The fans 18 are preferably of the type known as "muffin fans", providing a relatively thin profile, corresponding to a small vertical dimension in the illustrated embodiment. The speeds of the fans are continuously variable over a speed range corresponding to volume displacements of about 10 cubic feet per minute (CFM) to 90 CFM. Thus, the pair of fans in the illustrated embodiment have a combined total maximum output of about 180 CFM. Each fan has a diameter of about 4½ in. The fans are preferably driven by DC motors, and a suitable means to enable variation of DC voltage to the motors over a continuous range are included in a controller 40 which may also include means for controlling power to the thermistors as explained below.

Power for the PTC thermistors may be supplied by, e.g., standard 110 volt or 220 volt alternating current. Similarly, the fans may be powered by any convenient source of electric power, in combination with a suitable transformer.

One advantageous feature of the apparatus of the present invention is that it enables the thermistors to be operated at temperatures close to, but below, the combustion temperature of the stock, with little or no possibility of accidental charring or burning of stock, through a wide range of power outputs. In accordance with a further feature of the invention, means may be provided to control the power output of the apparatus while maintaining the thermistors at a temperature below the combustion temperature of the stock. Four methods of controlling the power output are described below.

The first method involves variation of airflow velocity and volumetric airflow rate through variation of fan speed. The second method involves variation of power supplied to the thermistors by independently switching selected ones of the thermistors 16 while maintaining airflow velocity and volumetric airflow rates at constant levels. The third method involves employment of a chopper-type controller to provide discontinuous power to the thermistors. The fourth method employs an integrating thermocontroller.

In accordance with the first method, an increase in airflow requirements and/or heat load requirements, due to, e.g., an increase in press speed, may be accommodated simply by increasing fan speed. The increased air flow initially causes a slight reduction in the PTC thermistor temperature, which reduces resistance, increasing the current flow through the thermistor. The increased current results in increased heat output, and results in the thermistor maintaining an equilibrium temperature slightly below its original point. A reduction in heat load requirements may be accommodated simply by reducing fan speed. This initially causes a slight increase in resistance and consequent reduction in current, thereby providing an equilibrium power output which may be much less than the original power output, with only a slight increase in the thermistor equilibrium temperature.

The second method as noted above involves variation of the power supplied to the thermistors while maintaining airflow velocity and volumetric airflow rates at constant levels. To this end, there is provided a control system which enables selected ones of the thermistors or pills 16 to be switched on and off independently of one another. The control system may be configured to switch the pills pairwise, with each pair comprising one pill from each cluster, such that each cluster has the same number of pills in the "on" state at any particular time. The control circuit enables each cluster to have any desired number of pills from 0–6 in the "on" state at any particular time.

The third method, as described above, involves employment of a chopper-type controller to effect provision of discontinuous power to the thermistors by effecting simultaneous switching of all of the thermistors between an "on" state and an "off" state.

The fourth method employs an integrating thermocontroller 80. The thermocontroller 80 includes a thermostat 86 which compares the actual air temperature downstream from the thermistors 16, i.e., the output temperature, with a preset reference temperature. The controller 80 selectively switches the thermistors between "on" and "off" positions as necessary to adjust the output temperature toward the reference temperature. When the actual output temperature is approaching the reference temperature, the controller 80 effects switching before the reference temperature is reached.

As illustrated, the controller effects switching of the thermistors 16 through the use of a relay 88. The controller selectively applies a 24 volt current to the relay 88 to effect switching of 220 volt current to the thermistors. Power for the thermistors as well as the controller is provided by a 220 volt power supply 82. A transformer 84 steps the voltage down to 24 volts for the relay 88.

A manual switch 90 may also be provided to enable the operator to override the controller and maintain the thermistors 86 constantly in the "on" state for a desired period of time. This may be useful, e.g., during start-up, or during other circumstances when it is desirable to maximize heat output.

The use of the controller 80 as described above enables setting and/or drying of ink to be accelerated to a desired degree with relatively little generation of heat and accordingly with relatively low energy consumption as compared with prior methods employing infrared drying apparatus.

The apparatus 10 enables acceptable rates of setting and drying to be obtained with a reduction of about 5° C. in pile temperature, as compared with prior methods employing conventional infrared dryers. The thermistor operating temperature is preferably maintained between about 180° C. and about 260° C., and an operating temperature of about 190° C. is preferred for the illustrated embodiment, which is particularly well-suited for use in setting ink and heating stock in small sheet-fed lithographic presses. Operation at about 190° C. generally presents little or no risk of charring or burning of stock in the event of a paper jam or other event causing paper to come into direct contact with the thermistors 16. Selection of thermistors operating at higher temperatures enables increased rates of heat transfer, but also may increase the risk of charring stock. Selection of thermistors operating at lower temperatures would result in decreased heat transfer rates for a given airflow rate. However, in other embodiments of the invention, e.g., in embodiments intended for use in drying water-based coatings on stock in high-pile presses, temperatures other than 190° C. may be preferred. The illustrated heating apparatus has a range of power output from about 0 to 4000 Watts.

The apparatus of the invention is capable of raising pile temperature by over 20° C., e.g., from an ambient temperature of 20° C. to a temperature of 40° C. in a typical printing operation involving a low-pile press with an output of 6500–8500 sheets/hr. of multicolor-printed offset enamel 8½×11 in. stock, operating with the fan providing airflow of about 100 CFM. In practical terms, this may eliminate the need for spray powder on finished stock and reduce drying time in the pile from several hours to a few minutes. The power consumption of the apparatus in this example is about 7½ A at 220 V. As described above, it is believed that a similar result in terms of reduction in drying time can also be achieved at a lower pile temperature if sufficiently high airflow rates are employed.

Figure 2:
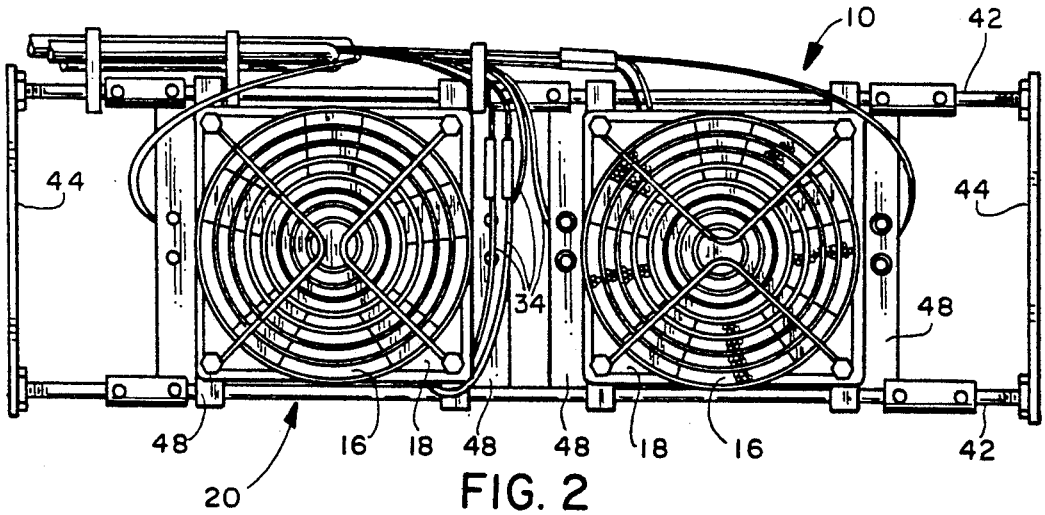
FIG. 2 is a plan view of the heating apparatus of FIG. 1.
Figure 3:
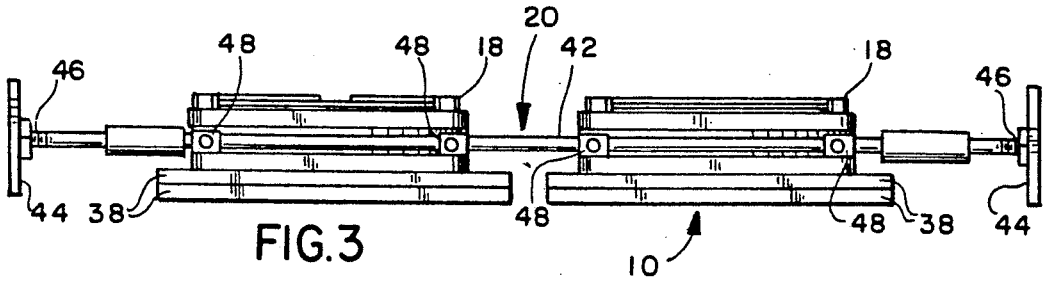
FIG. 3 is an elevational view of the heating apparatus of FIG. 1.
Figure 4:
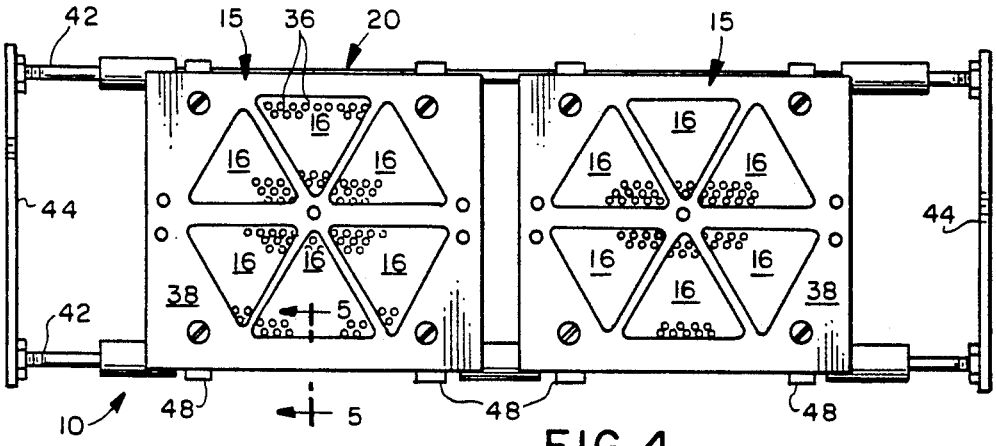
FIG. 4 is a bottom view of the heating apparatus of FIG. 1.

In the embodiment illustrated in FIGS. 2–4, the frame 20 comprises a pair of elongated rods 42 having their lengths selected to span the width of a press transfer bed, and having end brackets 44 for bolting or otherwise fastening to the sidewalls 22 of the press, attached to threaded ends 46 of the rods. The fans 18 and PTC thermistors 16 are supported on crossbars 48 having bores therein through which the rods pass.

Figure 6:
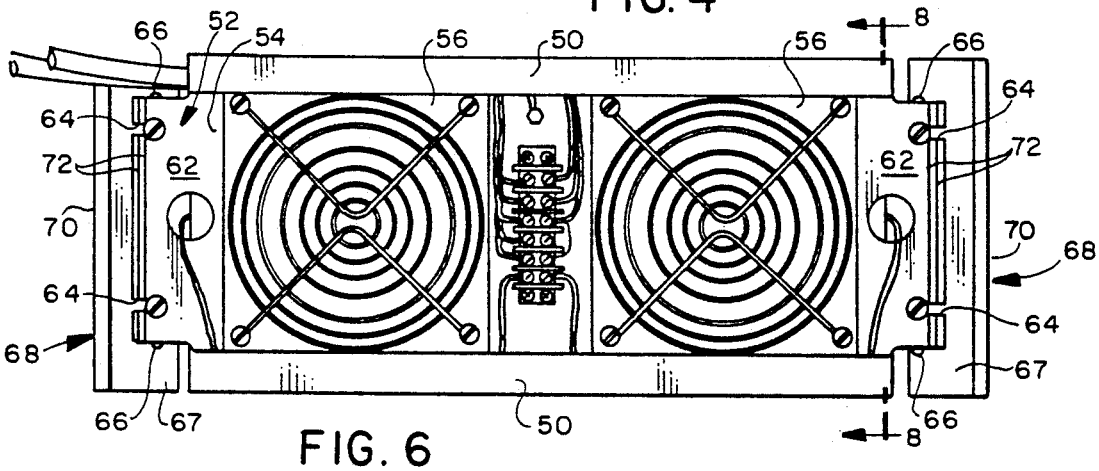
FIG. 6 is a plan view of heating apparatus in accordance with a second embodiment of the invention.
Figure 7:
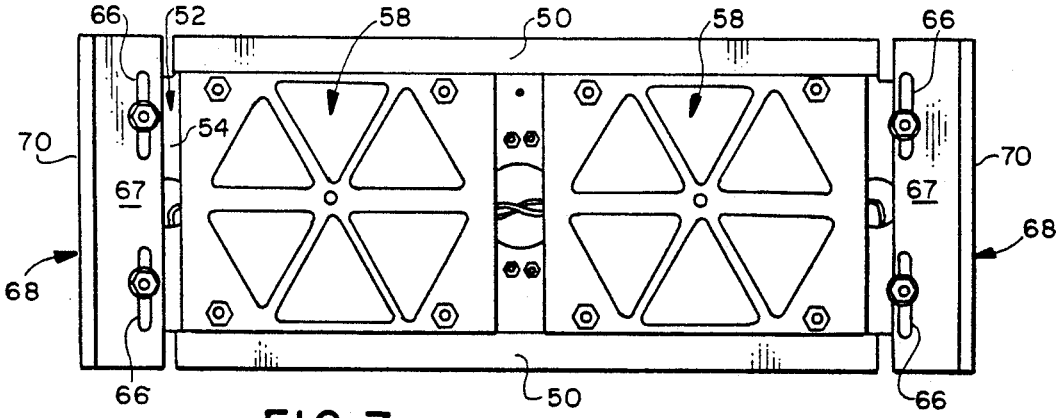
FIG. 7 is a bottom view of the heating apparatus of FIG. 6.
Figure 5:
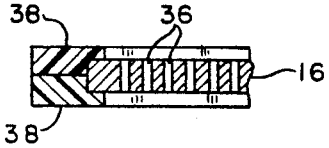
FIG. 5 is a fragmentary sectional view of a portion of the heating apparatus of FIG. 1, taken substantially along line 5—5 in FIG. 4.
Figure 8:
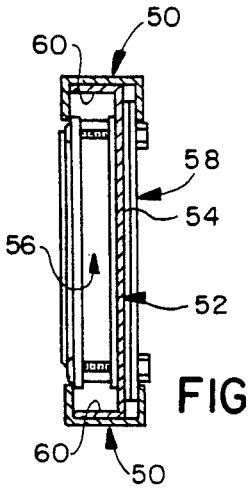
FIG. 8 is a sectional view taken substantially along line 8—8 in FIG. 6.
Figure 9:
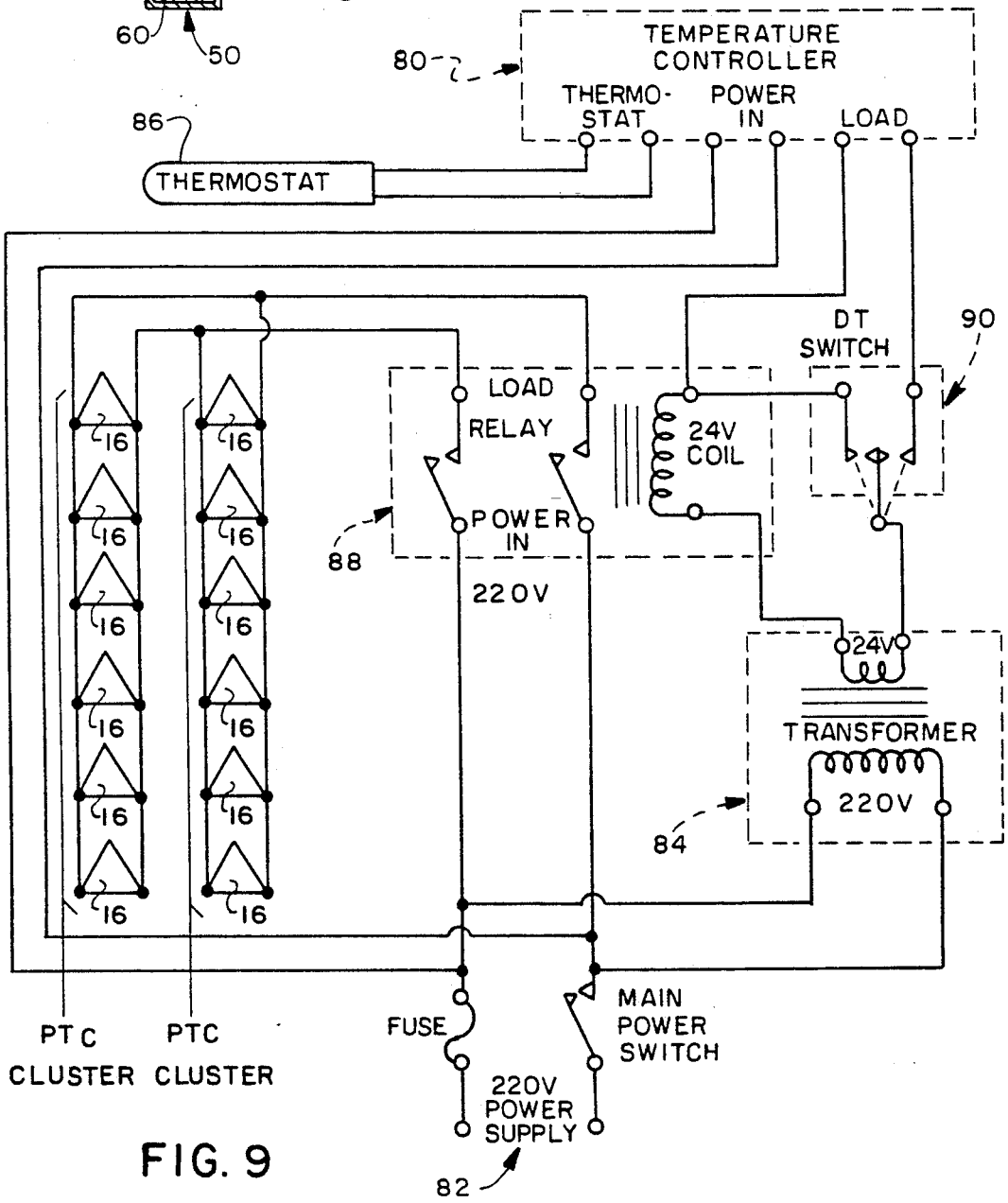
FIG. 9 is an electrical schematic diagram illustrating a control arrangement in accordance with a particular embodiment of the invention.

A further embodiment of the invention is illustrated in FIGS. 6–8. In this embodiment, the frame comprises a pair of channel-shaped site members 50 oriented with their concave sides facing. A channel-shaped central support member 52 is supported between the side members 50, each of which has a vertical dimension of about 1¾ in. The central support member is oriented with its concave side facing upward and its web 54 disposed horizontally to support fans 56 and thermistor assemblies 58. The web 54 has suitable openings for airflow therethrough, and extends longitudinally beyond the sides 60 to provide extensions 62 at each end. Each extension 62 has a pair of longitudinal open-ended slots 64 formed therein, disposed at locations corresponding to transverse closed slots 66 in horizontal portion 67 of end brackets 68 which, in the illustrated embodiment, have substantially T-shaped cross sections with the horizontal portions 67 extending inwardly from vertical walls 70. The vertical walls 70 are preferably pre-drilled at appropriate locations to facilitate bolting to press walls. The slots 64 in the web extensions 62 permit the central support member 52 to be bolted to the end brackets 68 so long as the spacing between the end brackets 68 is within a predetermined range, corresponding to the range of spacing between the interior surfaces of the press sidewalls which the apparatus 10 can conveniently accommodate.

Lines of weakness 72 are formed parallel to the ends 74 of the extensions 62 to facilitate shortening the support member 52 as necessary to accommodate narrow-width presses. The support member 52 is preferably welded to the opposite side members 50. In the alternative, a suitable extrusion might be employed in place of the separate side and central channel members.

The frame illustrated in FIGS. 6–8 thus provides an economical, easily assembled means of support which is adjustable to facilitate installation on presses having various dimensions between the sidewalls supporting the heating apparatus. Moreover, the apparatus is compact, having a vertical dimension of less than two inches, a width of about 6½ in., and a length of about 17 in., excluding the end brackets.

From the foregoing it will be appreciated that the invention provides a novel and improved method and apparatus for applying heat to printed or coated stock in a printing press. The invention is not limited to the embodiments described above or to any particular embodiment. In addition to the embodiments described above, it is contemplated that the invention could be embodied in apparatus employing a plenum disposed above an array of thermistors, without the use of fans disposed as described and illustrated above. Such an embodiment would be somewhat more bulky than the above described embodiments, and would be useful principally in presses of relatively large size. However, the use of a plenum as described above, would enable high airflow rates to be conveniently maintained, and consequently would enable high rates of drying water-based coatings in large presses. The invention is pointed out by the following claims.

What is claimed is:

1. A method of effecting temperature-controlled airflow to accelerate drying of liquid media on stock as said stock travels from a first location to a second location in a printing press, comprising:

supplying current to at least one PTC thermistor to maintain said PTC thermistor within a first temperature range having a maximum not greater than about 260° C., said thermistor having a Curie temperature in said first temperature range; and effecting flow of heated air over said liquid media on said stock by forcing air into heat exchange relation with said at least one PTC thermistor and subsequently into contact with said liquid media on said stock as said stock travels from said first location to said second location to accelerate drying of said liquid media.

2. A method in accordance with claim 1 wherein the step of forcing air into heat exchange relation with said at least one PTC thermistor sets ink on said printed stock and heats said stock to temperatures within a second temperature range.

3. A method in accordance with claim 2 wherein said heating of said stock raises the temperature of said stock by at least about 20° C.

4. A method in accordance with claim 1 wherein said first temperature range has a maximum temperature which is lower than the combustion temperature of said stock.

5. A method in accordance with claim 1 further comprising:

monitoring actual temperature of air after heat exchange with said PTC thermistors;

comparing said actual temperature with a predetermined reference temperature;

selectively interrupting the supply of current to said at least one PTC thermistor so as to maintain said at least one PTC thermistor in an "on" state during certain intervals and in an "off" state during certain other intervals to adjust said actual temperature toward said reference temperature.

6. A method in accordance with claim 1 wherein said first temperature range extends from about 180° C. to about 260° C.

7. A method in accordance with claim 1 wherein said first temperature range has a maximum of about 190° C.

8. A method in accordance with claim 1 wherein said at least one PTC thermistor comprises a plurality of PTC thermistors.

9. A method in accordance with claim 1 wherein the step of forcing air into heat exchange relation with said at least one PTC thermistor comprises operating a fan disposed directly adjacent said PTC thermistor to blow air through a plurality of perforations in said PTC thermistor.

10. A method in accordance with claim 1 wherein said printed stock has a water-based acrylic coating thereon over said ink as said stock travels from said first location to said second location, and wherein the step of forcing air into heat exchange relation with said at least one PTC thermistor and subsequently into contact with said printed stock has the effect of substantially drying said water-based acrylic coating.

11. Apparatus for effecting temperature-controlled airflow over printed stock having a liquid medium thereon as said stock travels from a first location to a second location in a printing press, comprising:

at least one PTC thermistor;

means for supplying current to said at least one PTC thermistor to maintain said at least one PTC thermistor within a first temperature range having a maximum not greater than about 260° C.; and means for effecting flow of heated air over said liquid medium by forcing air into heat exchange relation with said at least one PTC thermistor, and subsequently into contact with said printed stock as said stock travels from said first location to said second location to accelerate drying of said liquid medium.

12. Apparatus in accordance with claim 11 further comprising control means to vary at least one of the airflow rate and the thermistor power output to heat said stock to temperatures within a second temperature range as said stock travels from said first location to said second location.

13. Apparatus in accordance with claim 12 further comprising:

means for monitoring the actual temperature of air after heat exchange with said at least one PTC thermistor;

means for comprising said actual temperature with a predetermined reference temperature;

means for selectively interrupting the supply of current to said at least one PTC thermistor so as to maintain said at least one PTC thermistor in an "on" state during certain intervals and an "off" state during certain other intervals to adjust said actual temperature toward said reference temperature.

14. Apparatus in accordance with claim 11 wherein said first temperature range has a maximum temperature which is lower than the combustion temperature of said stock.

15. Apparatus in accordance with claim 11 wherein said first temperature range extends from about 180° C. to 260° C.

16. Apparatus in accordance with claim 11 wherein said first temperature range has a maximum of about 190° C.

17. Apparatus in accordance with claim 11 wherein said at least one PTC thermistor comprises a plurality of PTC thermistors.

18. Apparatus in accordance with claim 11 wherein said PTC thermistor has a plurality of perforations therein, and said fan is disposed directly adjacent said PTC thermistor to blow air through said perforations.

19. Apparatus in accordance with claim 11 wherein said apparatus raises the temperature of said stock by at least about 20° C.

20. A printing press comprising means for applying a substance to printing stock, means for transporting said stock to a delivery location after application of said substance thereto, and heating apparatus for applying heated air to said substance during transport of said stock, wherein said heating apparatus comprises:

at least one PTC thermistor having a Curie temperature of less than about 260° C. and having a substantially flat configuration;

means for supplying current to said PTC thermistor so as to maintain said PTC thermistor within a desired temperature range;

means to force air to flow into heat exchange relation with said thermistor and subsequently into heat exchange relation with said substance as said stock is transported; and a frame to support said heating apparatus above said stock and in close proximity thereto as said stock is transported.

21. Apparatus in accordance with claim 20 further comprising means to selectively interrupt current to said PTC thermistor.

22. Apparatus in accordance with claim 20 wherein said press includes a pair of generally vertical sidewalls having interior surfaces, and said frame includes one or more members which are adjustable relative to one another to permit said frame to fit between said sidewalls while accommodating various dimensions between said sidewalls.

23. Apparatus in accordance with claim 20 wherein said thermistors are disposed at a distance of about ½ in. to 4 inches above said stock.

24. Heating apparatus for installation on a printing press, comprising:

a frame;

at least one PTC thermistor supported on said frame;

means for supplying current to said thermistor so as to maintain said thermistor at a predetermined temperature above ambient temperature but not greater than about 260° C.; and a fan supported in said frame and disposed adjacent said thermistor to force air into heat exchange relation with said thermistor and subsequently to a desired location;

said frame including a pair of brackets having means thereon for mounting on generally vertical interior surfaces of opposite sidewalls of a printing press;

at least one of said brackets being adjustable so as to enable the distance between the brackets to be selected in accordance with a corresponding dimension on the printing press;

whereby said heating apparatus is capable of being mounted on presses having widths of different dimensions.

25. Apparatus in accordance with claim 24 wherein said apparatus has a vertical dimension of less than about 2 in.

26. Apparatus in accordance with claim 24 wherein each of said thermistors comprises a generally flat plate having a plurality of perforations therein.

* * * * *

UNITED STATES PATENT AND TRADEMARK OFFICE

CERTIFICATE OF CORRECTION

PATENT NO. : 5,168,811

DATED : December 8, 1992

INVENTOR(S) : Cox et al.

It is certified that error appears in the above-identified patent and that said Letters Patent is hereby corrected as shown below:

ON THE TITLE PAGE:

Under the "TDK PTC" reference, change "32 pgs." to --23 pgs.--;

Under the "Scarlett, et al." reference, change "pp. 74-84" to --pp. 77-84--.

In column 3, line 52, change "heat air" to --heated air--.

In column 5, line 51, after "increase in" insert --thermistor temperature, accompanied by an increase in--.

In Claim 13, column 9, line 29, change "comprising" to --comparing--.

Signed and Sealed this

Fourteenth Day of December, 1993

*Attest:*

*Attesting Officer*

BRUCE LEHMAN

*Commissioner of Patents and Trademarks*